US009016684B2

(12) United States Patent
Shih et al.

(10) Patent No.: US 9,016,684 B2
(45) Date of Patent: Apr. 28, 2015

(54) BANKNOTE HANDLING AND TRANSMISSION APPARATUS

(71) Applicant: Zhongshan Innocloud Intellectual Property Services Co., Ltd., Zhongshan (CN)

(72) Inventors: Chih-Kun Shih, Santa Clara, CA (US); Wan-Cheng Luo, Shenzhen (CN); Xiao-Mao Xie, Shenzhen (CN); Wei Xu, Shenzhen (CN); Kai-Hua Wu, Shenzhen (CN); Yong-Gui Pan, Shenzhen (CN)

(73) Assignee: Zhongshan Innocloud Intellectual Property Services Co., Ltd., Zhongshan (CN)

( * ) Notice: Subject to any disclaimer, the term of this patent is extended or adjusted under 35 U.S.C. 154(b) by 0 days.

(21) Appl. No.: 13/931,480

(22) Filed: Jun. 28, 2013

(65) Prior Publication Data

US 2014/0125008 A1 May 8, 2014

(30) Foreign Application Priority Data

Nov. 8, 2012 (CN) ..... 2012 1 04434053

(51) Int. Cl.
*B65H 3/06* (2006.01)
*G07D 11/00* (2006.01)

(52) U.S. Cl.
CPC ..... *G07D 11/0084* (2013.01)

(58) Field of Classification Search
CPC .... B65H 3/5215; B65H 3/523; B65H 3/5261; B65H 3/5284
USPC ..... 271/109, 121, 122
See application file for complete search history.

(56) References Cited

U.S. PATENT DOCUMENTS

| | | | | |
|---|---|---|---|---|
| 4,158,456 | A * | 6/1979 | Holland-Letz | 271/118 |
| 4,583,726 | A * | 4/1986 | Nogi et al. | 271/4.1 |
| 5,207,788 | A * | 5/1993 | Geib et al. | 271/122 |
| 5,545,882 | A * | 8/1996 | Tanaka | 235/98 R |
| 5,687,963 | A * | 11/1997 | Mennie | 271/119 |
| 6,000,689 | A * | 12/1999 | Furuki et al. | 271/10.11 |
| 6,983,880 | B2 * | 1/2006 | Graef et al. | 235/379 |
| 7,419,155 | B2 * | 9/2008 | Stoll et al. | 271/131 |
| 7,530,446 | B2 * | 5/2009 | Jackson et al. | 198/624 |
| 7,806,402 | B2 * | 10/2010 | Sato et al. | 271/165 |
| 8,382,107 | B2 * | 2/2013 | Wu et al. | 271/273 |
| 2009/0026692 | A1 * | 1/2009 | Iwami et al. | 271/118 |
| 2010/0052237 | A1 * | 3/2010 | Herczeg et al. | 271/3.16 |
| 2010/0225053 | A1 * | 9/2010 | Nakamura et al. | 271/264 |
| 2011/0018190 | A1 * | 1/2011 | Mandel et al. | 271/109 |

* cited by examiner

*Primary Examiner* — Jeremy R Severson
(74) *Attorney, Agent, or Firm* — Novak Druce Connolly Bove + Quigg LLP

(57) ABSTRACT

A banknote handling and transmission apparatus includes a drive roller, a driven structure, and a transmission device. The driven structure includes a mounting member and a first driven roller pivotally mounted to the mounting member. The transmission device includes a guiding panel, a bottom panel, a mounting portion secured to the guiding panel, and a transmission structure pivotally mounted to the guiding panel. A transmission channel is defined between the guiding panel and the bottom panel. The transmission apparatus includes a first transmission roller bearing against, and rotated by, the first drive roller, the first drive roller also forces the rotation of the first driven roller, to pick up deposited banknotes and move them squarely into the transmission channel.

16 Claims, 4 Drawing Sheets

BANKNOTE HANDLING AND TRANSMISSION APPARATUS

BACKGROUND

1. Technical Field

The present disclosure generally relates to currency counting machines, and particularly relates to a banknote handling and transmission apparatus used in a currency counter.

2. Description of Related Art

Vending machines are in common use for dispensing many types of items after the customers insert coins or banknotes or credit into the machines. A vending machine typically includes a banknote counter with a transmission apparatus for counting the banknotes. The banknote handling and transmission apparatus includes a shaft, a cushion, a bracket and a plurality of wheels and assembly of the apparatus is laborious and time-consuming.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
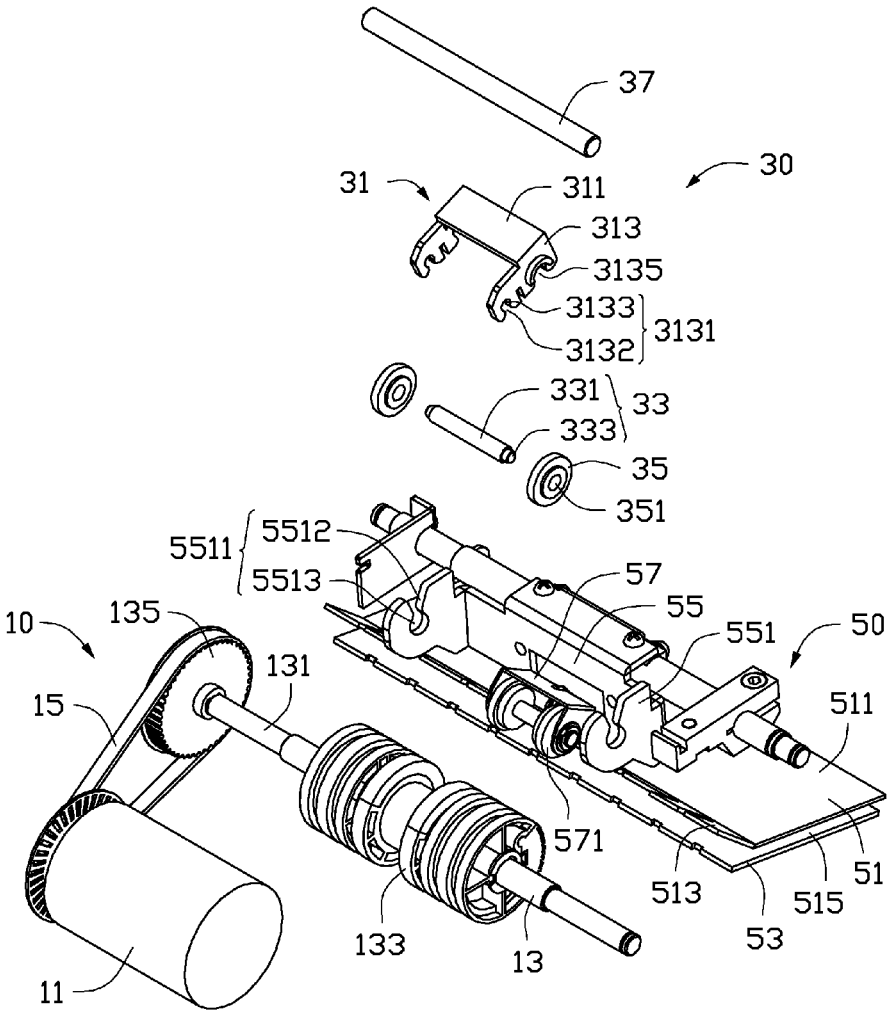
FIG. 1 is an exploded, isometric view of one embodiment of a banknote handling and transmission apparatus.

FIG. 1 shows that a banknote handling and transmission apparatus used in a currency counter, according to one embodiment, includes a drive device 10, a driven structure 30, and a transmission device 50.

The drive device 10 includes a motor 11 and a drive structure 13. The drive structure 13 includes a driven shaft 131, a plurality of driven rollers 133 mounted to the driven shaft 131, and a driven gear 135 secured to the driven shaft 131. The driven gear 135 is connected to the motor 11 via a belt 15.

The driven structure 30 includes a mounting member 31, a pivot shaft 33, and two driven rollers 35 parallel to each other. The mounting member 31 includes a connecting portion 311 and two mounting tabs 313 extending from the connecting portion 311. The two mounting tabs 313 are substantially parallel to each other. Each mounting tab 313 defines a mounting opening 3131 and a pivot hole 3135. The mounting opening 3131 defines a cutout 3132 and a mounting hole 3133 communicating with the cutout 3132. The cutout 3132 is V-shaped. The pivot shaft 33 includes shaft body 331 and two mounting protrusions 333, extending from the shaft body 331. The cross section of the mounting protrusion 333 is less than that of the shaft body 331. The driven roller 35 defines a rotating hole 351 corresponding to the pivot shaft 33. The driven structure 30 further includes a rotating shaft 37. The rotating shaft 37 corresponds to the rotating hole 351.

The transmission device 50 includes a guiding panel 51, a bottom panel 53, a mounting portion 55 secured to the guiding panel 51, and a transmission structure 57 pivotally mounted to the guiding panel 51. The guiding panel 51 includes a panel body 511 and a guiding portion 513 inclined and extending from the panel body 511. The panel body 511 is substantially parallel to the bottom panel 53. A transmission channel 515 is defined between the guiding panel 51 and the bottom panel 53. The mounting portion 55 includes two rotating portions 551 substantially parallel to each other. Each rotating portion 551 defines a securing opening 5511. The securing opening 5511 defines a connecting opening 5512 and a securing hole 5513 communicating with the connecting opening 5512. The connecting opening 5512 is V-shaped. The securing opening 5511 secures the rotating shaft 37. The transmission structure 57 includes two transmission rollers 571.

Figure 2:
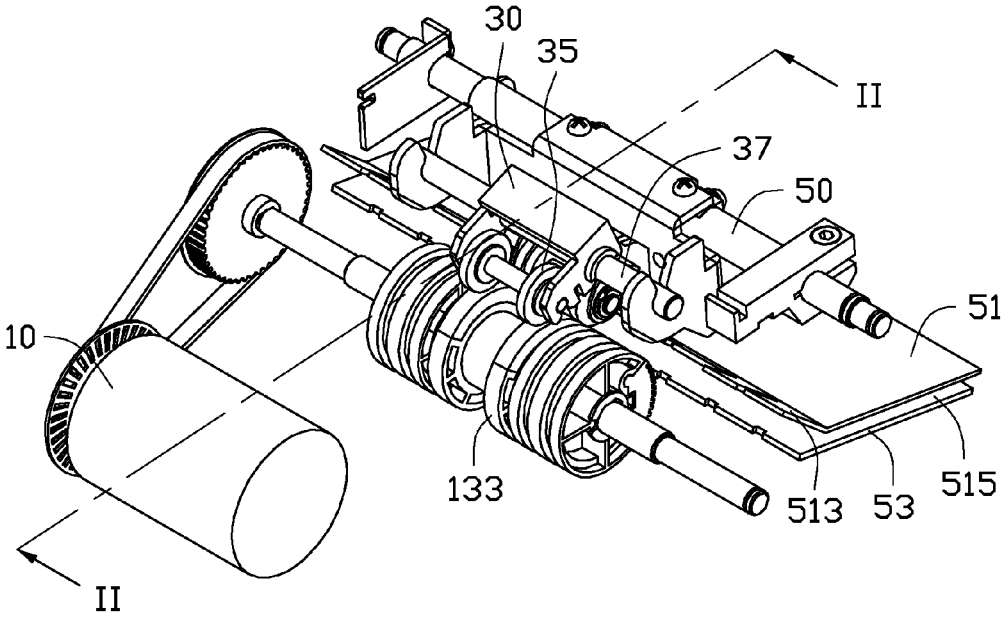
FIG. 2 is an assembled view of the banknote handling and transmission apparatus of FIG. 1.
Figure 3:
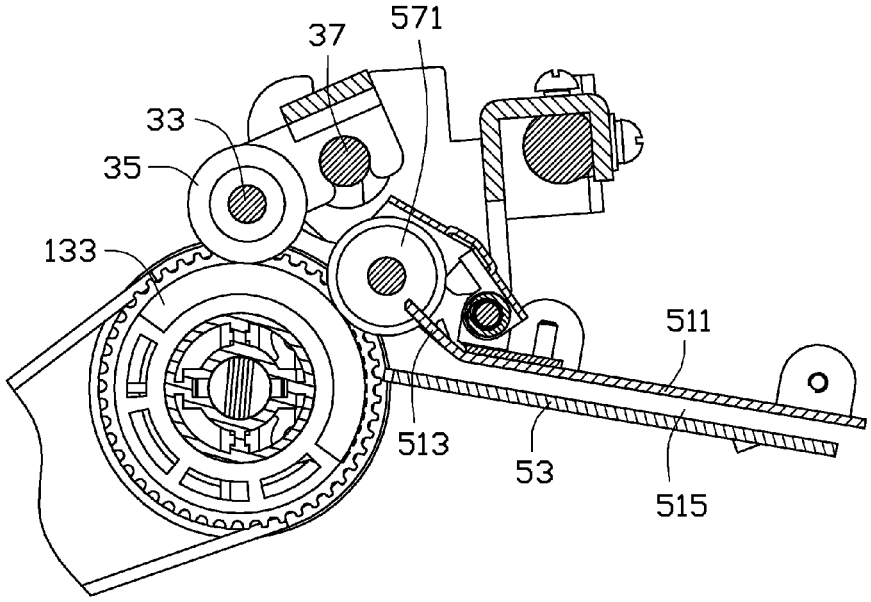
FIG. 3 is a cross-sectional view of the banknote handling and transmission apparatus of FIG. 2 taken along a line III-III.

FIGS. 2 and 3 show that, in assembly, the pivot shaft 33 passes through the rotating holes 351 of the two driven rollers 35 to enable the two driven rollers 35 to be pivotally mounted to the pivot shaft 33. The two mounting protrusions 333 of the pivot shaft 33 are pushed in the mounting holes 3133 of the mounting openings 3131 via the cutouts 3132. At this time, the two driven rollers 35 are located between the two mounting tabs 313 of the mounting member 31. The rotating shaft 37 passes through the two pivot holes 3135 to enable the mounting member 31 to be pivotally mounted to the rotating shaft 37. The rotating shaft 37 is pushed into the securing holes 5513 of the securing openings 5511 via the connecting openings 5512. At this time, the mounting member 31 is located between the two rotating portions 551 of the mounting portion 55. The drive rollers 133 of the drive device 10 make contact with the two driven rollers 35 of the driven structure 3 and the two transmission rollers 571.

Figure 4:
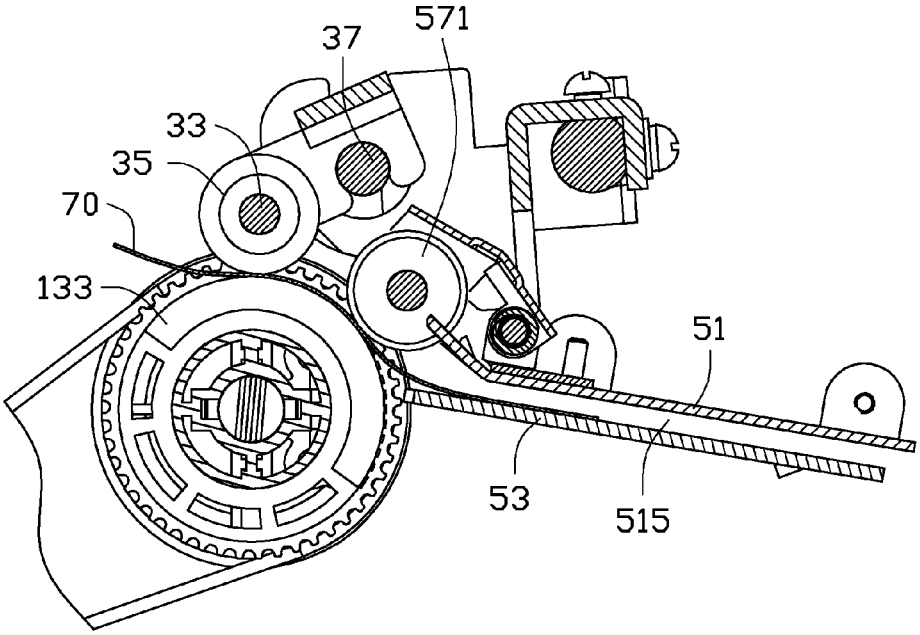
FIG. 4 is a cross-sectional view of the banknote handling and transmission apparatus of FIG. 2 taken along a line III-III of FIG. 2, a banknote being transmitted.

FIG. 4 shows that, in use, when a banknote 70 is located in a position which is between the two driven rollers 35 and the two drive rollers 133, the drive rollers 133 rotate, driven by the motor 11, to drive the two driven rollers 35 to rotate, thereby moving the banknote 70 into the transmission channel 515. The banknote 70 is prevented from sticking, or twisting out of alignment, because of the stable frictional forces exerted by the two driven rollers 35.

It is to be understood, however, that even though numerous characteristics and advantages of the embodiments have been set forth in the foregoing description, together with details of the structure and function of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A banknote handling and transmission apparatus comprising:

a drive roller;

a driven structure, the driven structure comprises a mounting member and a first driven roller pivotally mounted to the mounting member;

a transmission device, the transmission device comprises a guiding panel, a bottom panel, a mounting portion secured to the guiding panel, and a transmission structure pivotally mounted to the guiding panel; a transmission channel is defined between the guiding panel and the bottom panel; and the transmission structure comprises a first transmission roller;

wherein the mounting member is pivotally mounted to the mounting portion; the first driven roller and the first transmission roller contact the drive roller; and the drive roller is configured to drive the first driven roller and the first transmission roller to rotate to enable a banknote, driven by the first driven roller and the first transmission roller, to move into the transmission channel; the driven structure further comprises a pivot shaft; the mounting member comprises a connecting portion and two mounting tabs extending from the connecting portion; each of the two mounting tabs defines a mounting opening; the pivot shaft is mounted in the two mounting openings; and the first driven roller is pivotally mounted to the pivot shaft and located between the two mounting tabs; each of the two mounting tabs further defines a rotating hole; the driven structure further comprises a rotating shaft; the mounting portion comprises two rotating portions substantially parallel to each other; each of the two rotating portions defines a securing opening; the rotating shaft is configured to pass through the two rotating holes to enable the mounting member to be pivotally mounted to the rotating shaft; the rotating shaft is mounted in the two securing openings; and the mounting member is located between the two rotating portions; and the first driven roller contacts the drive roller to drive the banknote to move into the transmission channel.

2. The banknote handling and transmission apparatus of claim 1, wherein the driven structure further comprises a second driven roller that is substantially parallel to the first driven roller, and the second driven roller is pivotally mounted to the pivot shaft and located between the two mounting tabs.

3. The banknote handling and transmission apparatus of claim 1, wherein the mounting opening defines a cutout and a mounting hole communicated with the cutout; the cutout is V-shaped; and the pivot shaft is configured to be mounted into the mounting hole via the cutout.

4. The banknote handling and transmission apparatus of claim 3, wherein the pivot shaft comprises a shaft body and two mounting protrusions extending from the shaft body; a cross section of each of the two mounting protrusions is less than a cross section of the shaft body.

5. The banknote handling and transmission apparatus of claim 1, wherein each of the two securing openings defines a connecting opening and a securing hole communicated with the connecting opening; the connecting opening is V-shaped; and the rotating shaft is configured to be mounted into the two securing holes via the two connecting openings.

6. The banknote handling and transmission apparatus of claim 1, wherein the guiding panel comprises a panel body and a guiding portion extending from the panel body; the panel body is substantially parallel to the bottom panel; and the guiding portion is configured to guide the banknote to move into the transmission channel.

7. The banknote handling and transmission apparatus of claim 1, further comprising a driven shaft secured to the drive roller and a driven gear secured to the driven shaft, and the driven gear is connected to a motor via a belt.

8. The banknote handling and transmission apparatus of claim 1, wherein the rotating hole is substantially semicircular.

9. A banknote handling and transmission apparatus comprising:

a drive roller;

a driven structure, the driven structure comprises a mounting member and a first driven roller pivotally mounted to the mounting member;

a transmission device, the transmission device comprises a guiding panel, a bottom panel and a mounting portion secured to the guiding panel; and a transmission channel is defined between the guiding panel and the bottom panel;

wherein the mounting member is pivotally mounted to the mounting portion; the first driven roller; and the drive roller is configured to rotate along a first rotation direction to drive a banknote, located between the first driven roller and the drive roller, to move to drive the first driven roller to rotate, along a second direction opposite to the first rotation direction, thereby enabling the banknote to move into the transmission channel; the driven structure further comprises a pivot shaft; the mounting member comprises a connecting portion and two mounting tabs extending from the connecting portion; each of the two mounting tabs defines a mounting opening; the pivot shaft is mounted in the two mounting openings; and the first driven roller is pivotally mounted to the pivot shaft and located between the two mounting tabs; each of the two mounting tabs further defines a rotating hole; the driven structure further comprises a rotating shaft; the mounting portion comprises two rotating portions substantially parallel to each other; each of the two rotating portions defines a securing opening; the rotating shaft is configured to pass through the two rotating holes to enable the mounting member to be pivotally mounted to the rotating shaft; the rotating shaft is mounted in the two securing openings; and the mounting member is located between the two rotating portions; and the first driven roller contacts the drive roller to drive the banknote to move into the transmission channel.

10. The banknote handling and transmission apparatus of claim 9, wherein the driven structure further comprises a second driven roller that is substantially parallel to the first driven roller, and the second driven roller is pivotally mounted to the pivot shaft and located between the two mounting tabs.

11. The banknote handling and transmission apparatus of claim 9, wherein the mounting opening defines a cutout and a mounting hole communicated with the cutout; the cutout is V-shaped; and the pivot shaft is configured to be mounted into the mounting hole via the cutout.

12. The banknote handling and transmission apparatus of claim 11, wherein the pivot shaft comprises a shaft body and two mounting protrusions extending from the shaft body; a cross section of each of the two mounting protrusions is less than a cross section of the shaft body.

13. The banknote handling and transmission apparatus of claim 9, wherein each of the two securing openings defines a connecting opening and a securing hole communicated with the connecting opening; the connecting opening is V-shaped; and the rotating shaft is configured to be mounted into the two securing holes via the two connecting openings.

14. The banknote handling and transmission apparatus of claim 9, wherein the guiding panel comprises a panel body and a guiding portion extending from the panel body; the panel body is substantially parallel to the bottom panel; and the guiding portion is configured to guide the banknote to move into the transmission channel.

15. The banknote handling and transmission apparatus of claim 9, wherein the transmission device further comprises a transmission structure; the transmission structure comprises a transmission roller; the transmission roller and the drive roller are configured to rotate to drive the banknote to the transmission channel.

16. The banknote handling and transmission apparatus of claim 9, wherein the rotating hole is substantially semicircular.

* * * * *